US005217230A

United States Patent [19]

Judd

[11] Patent Number: 5,217,230

[45] Date of Patent: Jun. 8, 1993

[54] MULTI-SPORTS NET

[76] Inventor: Grant L. Judd, 1302 S. Hoytsville Rd., Coalville, Utah 84017

[21] Appl. No.: 828,023

[22] Filed: Jan. 30, 1992

[51] Int. Cl.[5] ..... A63B 61/00; A63B 67/00

[52] U.S. Cl. ..... 273/401; 273/298; 273/400; 273/402

[58] Field of Search ..... 273/401, 399, 400, 402, 273/29 B

[56] References Cited

U.S. PATENT DOCUMENTS

| | | | |
|---|---|---|---|
| 1,064,914 | 6/1913 | Jones | 273/399 X |
| 2,042,424 | 5/1936 | Estes | 273/402 |
| 2,707,635 | 5/1955 | Burman | 273/29 B |
| 2,932,516 | 4/1960 | Penner | 273/402 |
| 4,254,952 | 3/1981 | Playtor, Jr. | 273/401 X |
| 4,492,380 | 1/1985 | Saytar | 273/400 X |
| 4,592,547 | 6/1986 | Thaxton | 273/402 X |
| 4,796,886 | 1/1989 | Loh | 273/401 X |
| 4,863,166 | 9/1989 | Becera et al. | 273/26 A |
| 4,883,272 | 11/1989 | Lay | 273/26 A |
| 4,905,996 | 3/1990 | Tallent et al. | 273/401 X |
| 4,997,185 | 3/1991 | Bartasius | 273/29 B |
| 5,000,461 | 3/1991 | Borazjani | 273/401 |

*Primary Examiner*—William H. Grieb
*Attorney, Agent, or Firm*—John R. Flanagan

[57] ABSTRACT

A multi-sports net includes an elongated main meshwork and a target assembly attached thereto. The main meshwork has an opening defined at a generally central location. The target assembly includes a substantially rigid annular support member attached to the main meshwork of the net so as to surround the central opening therein. The target assembly also includes an auxiliary meshwork in the form of a pouch having an open end. The auxiliary meshwork is attached to the annular support member with the open end of the pouch formed by the auxiliary meshwork in communication with the opening through the main meshwork.

17 Claims, 1 Drawing Sheet

MULTI-SPORTS NET

BACKGROUND OF THE INVENTION

1. Field of the Invention

The present invention generally relates sports practice aids and, more particularly, is concerned with a multi-sports net.

2. Description of the Prior Art

To develope skill in a particular sport, an individual must spend a considerable amount of time in practicing the basic techniques required by the sport. Public and private facilities for playing sports and for practicing basic sports techniques are widespread but are typically heavily utilized and oftentimes expensive to join and use. Also, frequent use of these facilities by members of a family to practice and play sports means that a considerable amount of time will be spent away from home, resulting in a corresponding undesirable diminution in amount of time the family members can spend together.

Among the most popular sports games played by members of a typical sports-minded family are volleyball, badminton, tennis, soccer, baseball, softball, basketball and football. Skillful play of these sports requires that individuals have the ability to accurately pitch, throw, hit or kick balls at targets, such as a strike zone, another player, or a place on a court.

Heretofore, practice aids designed for particular sports have been proposed. For example, different aids for practicing skill in pitching, throwing, hitting and kicking balls employed in different sports, are known in the prior patent art. Representative examples of the prior art sports aids are disclosed in U.S. Pat. No. 4,863,166 to Becera et al, U.S. Pat. No. 4,883,272 to Lay, U.S. Pat. No. 4,997,185 to Bartasius, and U.S. Pat. No. 5,000,461 to Borazjani. While these prior art sports practice aids may function reasonably well under the limited range of conditions for which they were designed, none appears to have the versatility desired to meet the requirements of all members of a typical sports family. Having on hand a different sports practice aid for each different sport played by each family members requires that sufficient space be available in which to use and store the equipment and entails the expenditure of a considerable amount of money to purchase the equipment.

Thus, a need still exists for a versatile sports aid which will be useful in practicing and playing different sports.

SUMMARY OF THE INVENTION

The present invention provides a multi-sports net designed to satisfy the aforementioned needs. The mutli-sports net of the present invention is versatile in that can be used as the net for playing several different sports, such as volleyball, badminton and tennis, and as the target for practicing different skills, such as pitching, throwing, hitting and kicking balls, employed in different sports, such as tennis, soccer, baseball, softball, basketball and football.

Accordingly, the present invention is directed to a multi-sports net which comprises an elongated main meshwork has a pair of opposite side edges and a pair of opposite top and bottom edges. The length of the main meshwork between opposite side edges is substantially greater than its width between opposite top and bottom edges. An opening is defined in the main meshwork at a generally central location between its opposite side edges.

The target assembly includes a substantially rigid annular support member attached to the main meshwork of the net so as to surround the central opening therein. The target assembly also includes an auxiliary meshwork in the form of a pouch having an open end. The auxiliary meshwork is attached to the annular support member with the open end of the pouch formed by the auxiliary meshwork in communication with the opening through the main meshwork. The auxiliary meshwork of the pouch extends from one face of the main meshwork. The annular member surrounds the opening of the main meshwork so as to serve as a target for an object pitched, thrown, hit, or kicked toward the main meshwork of the net. The pouch of the target assembly serves to catch the object upon passing through the annular member and the opening in the main meshwork.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3:
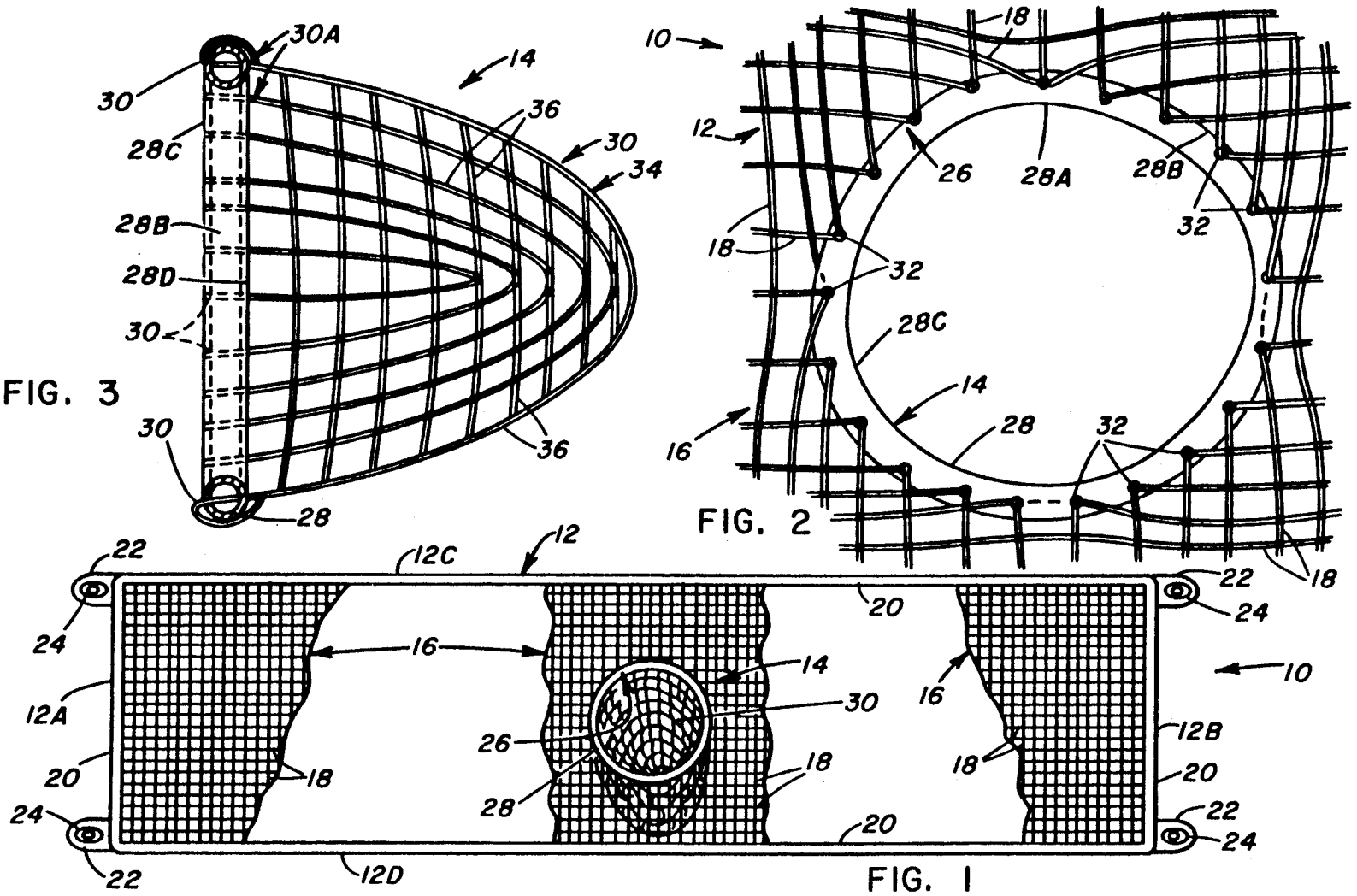
FIG. 1 is in front elevational view of a multi-sports net of the present invention.
FIG. 2 is an enlarged front elevational view of a central portion of the multi-sports net of FIG. 1, showing an annular support member of a target assembly attached to the main meshwork of the net so as to surround a central opening defined therein, but with an auxiliary meshwork of the target assembly which forms a pouch being omitted.
FIG. 3 is a side elevational view of the target assembly of the multi-sports net of FIG. 2 removed from the main meshwork.

Referring to the drawings and particularly to FIG. 1, there is illustrated a multi-sports net, generally designated 10, of the present invention, mountable between suitable support structures, such as a pair of support poles (not shown). The multi-sports net 10 can be used in the playing of several popular sports games, such as volleyball, badminton and tennis. The net 10 also can be used in practicing pitching, throwing, hitting or kicking skills, some of which are used in volleyball, badminton and tennis as well as in other popular sports games, such as soccer, baseball, softball, basketball and football.

Referring to FIGS. 1–3, the multi-sports net 10 basically includes an elongated main flexible meshwork 12 and a target assembly 14 attached thereto. The main meshwork 12 of the net 10 includes an elongated, preferably rectangular, panel of flexible netting 16 which can be any suitable commercially available type such as that composed of interweaved cords 18 of nylon material attached to one another at locations where they crisscross one another. The main meshwork 12 has a pair of opposite side edges 12A, 12B and a pair of opposite top and bottom edges 12C, 12D.

A narrow band 20 of a suitable flexible material is folded over and attached to the respective side edges 12A, 12B and top and bottom edges 12C, 12D to provide a border about the perimeter of the panel of netting 16. The length of the main meshwork 12 between its side edges 12A, 12B is substantially greater than the width between its top and bottom edges. Mounting tabs 22 of a suitable material are attached to the band 20 at the opposite sides 12A, 12B of the main meshwork 12 adjacent to the corners formed respectively with the opposite top and bottom 12C, 12D thereof. The mounting tabs 22 contain rigid eyelets 24, such as fabricated of metal, for connecting and suspending the main meshwork 12 in a relatively taut condition between a pair of stationary support structures (not shown).

The panel of netting 16 of the main meshwork 12 has an opening 26 defined therein at a generally central, or centered, location between its opposite side edges 12A, 12B and opposite top and bottom edges 12C, 12D. As an example, the length and width of the main meshwork 12 can be twenty feet and forty-two inches, respectively. The opening 26 can be twenty inches in diameter and displaced eleven inches from both the top and bottom edges 12C, 12D of the main meshwork 12.

The target assembly 14 of the net 10 includes a substantially rigid annular support member 28 and an auxiliary flexible meshwork 30. The annular member 28 of the target assembly 14 preferably is a hollow tubular ring of circular configuration. The annular member 28 has opposite interior and exterior circumferentially-extending sides 28A, 28B. It is fabricated of either plastic or metal material. As an example, it can have a diameter of one inch. The annular member 28 has a plurality of pairs of aligned holes 32 spaced about its circumference and defined through its opposite faces 28C, 28D along axes extending in transverse relation to its diameter. The annular member 28 is attached to the main meshwork 12 of the net so as to surround the central opening 26 therein at the interior side 28A of the annular member 28. More particular, ends of the flexible cords 18 of the netting 16 about the opening 26 are threaded through the holes 32 in the annular member 28 and attached about only the exterior side 28B of the annular member 28.

The auxiliary meshwork 30 of the target assembly 14 is in the form of a pouch 30 having an open end 30A. The auxiliary meshwork 30 is preferably made from a flexible netting 34 composed of interweaved cords 36, preferably of nylon material, attached to one another at locations where they criss-cross one another. The ends of the cords of the auxiliary meshwork pouch 30 at the open end 30A thereof are threaded through the holes 32 in the annular member 28 and attached about only the exterior side 28B of the annular member such that the open end 30A of the 30 communicates with the opening 26 through the main meshwork 12. The auxiliary meshwork pouch 30 extends from a rear face of the main meshwork 12, as seen in FIG. 3.

The annular member 28 of the target assembly 14 by surrounding the opening 26 in the main meshwork 12 can serve as a target for an object pitched, thrown, hit, or kicked toward the main meshwork 12 of the net 10. The auxiliary meshwork pouch 30 of the target assembly 14 can serve to catch the object upon passing through the annual member 28 and the opening 26 in the main meshwork 12.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A multi-sports net, comprising:

(a) an elongated man flexible meshwork having an opening defined therein; and (b) a target assembly including a substantially rigid annular member attached to said main meshwork so as to surround said opening therein and thereby serve as a target for an object pitched, thrown, hit or kicked toward said main meshwork;

(c) said annular member having a circumference and a diameter and a plurality of pairs of aligned holes spaced about said circumference of said diameter of said annular member, said annular member having circumferentially-extending opposite interior and exterior sides, said annular member at said interior side surrounding said opening in said meshwork;

(d) said meshwork including an elongated panel of flexible netting composed of interweaved cords attached to one another at locations where they criss-cross one another, said cords having ends at said opening of said meshwork being threaded through said holes in said annular member and attached about only said exterior side of said annular member.

2. The net of claim 1 wherein said main meshwork has a pair of opposite side edges and a pair of opposite top and bottom edges, the length of said main meshwork between said opposite side edges there being substantially greater than a width between said opposite top and bottom edges thereof.

3. The net of claim 2 wherein said opening in said main meshwork and said annular support member attached to said main meshwork and surrounding said opening are disposed between said opposite side edges and said opposite top and bottom edges of said main meshwork.

4. The net of claim 2 wherein said opening in said main meshwork is defined at a generally central location between said opposite side edges thereof.

5. The net of claim 1 wherein said main meshwork also includes a narrow band of flexible material folded over and attached to said panel of netting at said respective side edges and top and bottom edges of said main meshwork to provide a border about a perimeter of said panel of netting.

6. The net of claim 5 wherein said main meshwork further includes a plurality of mounting tabs attached to said band at said opposite sides of said main meshwork and adjacent to said opposite top and bottom thereof for use in connecting and suspending said main meshwork in a relatively taut condition.

7. The net of claim 1 wherein said target assembly also includes an auxiliary meshwork in the form of a pouch having an open end, said pouch being attached to said annular member with said open end of said pouch in communication with said opening in said main meshwork such that said pouch can serve to catch the object upon passing through said annular member and said opening in the main meshwork.

8. The net of claim 7, wherein said auxiliary meshwork is a flexible netting composed of interweaved cords attached to one another at locations where the criss-cross one another.

9. The net of claim 7 wherein said main meshwork has opposite faces, said pouch extending from one of said faces of said main meshwork.

10. The net of claim 7 wherein said annular member is composed of a plastic material.

11. The net of claim 7 wherein said annular member is composed of a metal material.

12. The net of claim 1 wherein said main meshwork has a pair of opposite side edges and includes a plurality of mounting elements attached to said opposite side edges thereof.

13. A multi-sports net, comprising:

(a) an elongated main flexible meshwork including an elongated panel of flexible netting having an opening defined therein at a general central location;

(b) a substantially rigid annular member attached to said main meshwork so as to surround said opening therein and thereby serve as a target for an object pitched, thrown, hit or kicked toward said main meshwork; and (c) an auxiliary meshwork in the form of a pouch of flexible netting having an open end, said pouch being attached to said annular member with said open end of said pouch in communication with said opening in said main meshwork such that said pouch can serve to catch the object upon passing through said annular member and said opening in the main meshwork;

(d) said annular member having a circumference and a diameter and a plurality of pairs of aligned holes spaced about said circumference of said annular member and defined through opposite faces of said annular member along axes extending in transverse relation to said diameter of said annular member, said annular member having circumferentially-extending opposite interior and exterior sides, said annular member at said interior side surrounding said opening in said meshwork;

(e) said flexible netting of said main and auxiliary meshworks being composed of interweaved cords attached to one another at locations where they criss-cross one another, said cords of said flexible netting of said main and auxiliary meshworks having respective ends at said opening of said main meshwork and at said open end of said auxiliary meshwork being threaded through said holes in said annular member and attached about only said exterior side of said annular member.

14. The net of claim 13 wherein said main meshwork has a pair of opposite side edges and a pair of opposite top and bottom edges, the length of said main meshwork between said opposite side edges there being substantially greater than a width between said opposite top and bottom edges thereof.

15. The net of claim 14 wherein said opening in said main meshwork and said annular support member attached to said main meshwork and surrounding said opening are disposed between said opposite side edges and said opposite top and bottom edges of said main meshwork.

16. The net of claim 13 wherein said main meshwork also includes a narrow band of flexible material folded over and attached to said panel of netting at said respective side edges and top and bottom edges of said main meshwork to provide a border about a perimeter of said panel of netting.

17. The net of claim 16 wherein said main meshwork further includes a plurality of mounting tabs attached to said band at said opposite sides of said main meshwork and adjacent to said opposite top and bottom thereof for use in connecting and suspending said main meshwork in a relatively taut condition.

* * * * *